United States Patent [19]

Cook, Jr. et al.

[11] 4,146,445

[45] Mar. 27, 1979

[54] METHOD OF ELECTROLYTICALLY PRODUCING A PURIFIED ALKALI METAL HYDROXIDE SOLUTION

[75] Inventors: Edward H. Cook, Jr., Niagara Falls; Dirk Pouli, Williamsville, both of N.Y.

[73] Assignee: Hooker Chemicals & Plastics Corp., Niagara Falls, N.Y.

[21] Appl. No.: 864,306

[22] Filed: Dec. 27, 1977

[51] Int. Cl.[2] ..... C25B 1/20; C25B 1/26

[52] U.S. Cl. ..... 204/98; 204/128

[58] Field of Search ..... 204/98, 128

[56] References Cited

U.S. PATENT DOCUMENTS

| | | | |
|---|---|---|---|
| 3,878,072 | 4/1975 | Cook et al. | 204/98 |
| 3,959,095 | 5/1976 | Marks et al. | 204/98 |

*Primary Examiner*—R. L. Andrews

*Attorney, Agent, or Firm*—Peter F. Casella; Howard M. Ellis

[57] ABSTRACT

A method for electrolytically producing a purified alkali metal hydroxide solution by electrolyzing an alkali halide solution in a membrane cell is described. The membrane cell includes at least one buffer compartment separating an anolyte and a catholyte compartment. The barrier separating the anolyte and the buffer compartment is a porous or permeable membrane. The membrane separating the catholyte compartment and the buffer compartment is a cation-active, hydrocarbon, preferably non-porous, membrane. A minor amount of a compound selected from the group consisting of alkali metal sulfites, bisulfites, sulfides, oxalates, or mixtures thereof, is added to the electrolyte, preferably with the brine feed, to protect the membranes from hypohalites formed in the cell. Amounts of protective compounds between about 0.01 and about 2.0 percent by weight of electrolyte are found to be aptly suited to use.

13 Claims, 1 Drawing Figure

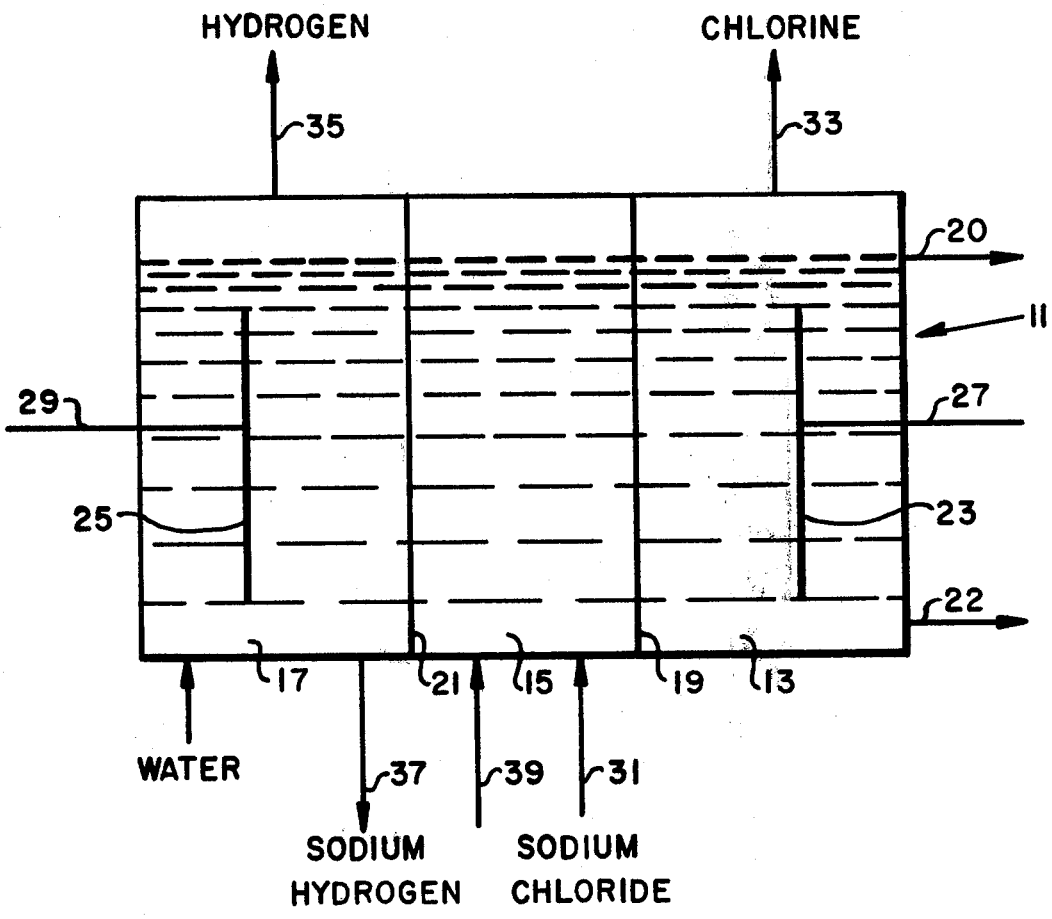
HYDROGEN
CHLORINE
35
33
20
11
29
27
25
23
22
17
21
15
19
13
WATER
37
39
31
SODIUM
HYDROGEN
SODIUM
CHLORIDE

METHOD OF ELECTROLYTICALLY PRODUCING A PURIFIED ALKALI METAL HYDROXIDE SOLUTION

BACKGROUND OF THE INVENTION

The present invention relates to the electrolytic production of high purity alkali metal hydroxide solutions. The alkali metal hydroxides of the present invention are produced along with halides utilizing membrane electrolytic cells by the passage of an electric current through a alkali metal halide solution.

Electrolytic cells that are commonly employed commercially for the conversion of alkali metal halides into alkali metal hydroxides and halides may be considered to fall into the following general types: (1) diaphragm, (2) mercury, and (3) membrane cells.

Diaphragm cells utilize one or more diaphragms permeable to the flow of electrolyte solution but impervious to the flow of gas bubbles. The diaphragm separates the cell into two or more compartments. Upon imposition of a decomposing current, halide gas is given off at the anode, and hydrogen gas and alkali metal hydroxide are formed at the cathode. Although the diaphragm cell achieves relatively high production per unit floor space, at low energy requirements and at generally high current efficiency, the alkali metal hydroxide product, or cell liquor, from the catholyte compartment is both dilute and impure. The product may typically contain about 12 percent by weight of alkali metal hydroxide along with about 12 percent by weight of the original, unreacted, alkali metal chloride. In order to obtain a commercial or salable product, the cell liquor must be concentrated and purified. Generally, this is accomplished by evaporation. Typically, the product from the evaporators is about 50 percent by weight alkali metal hydroxide containing about 1 percent by weight alkali metal chloride.

Mercury cells typically utilize a moving or flowing bed of mercury as the cathode and produce an alkali metal amalgam on the mercury cathode. Halide gas is produced at the anode. The amalgam is withdrawn from the cell and treated with water to produce a high purity alkali metal hydroxide. Although mercury cell installations have a high initial capital investment, undesirable ratio of floor space per unit of product, relatively poor efficiencies, and negative ecological considerations, the purity of the alkali metal hydroxide product is an inducement to its use. Typically, the alkali metal hydroxide product contains less than 0.05 percent by weight of contaminating foreign anions.

Membrane cells utilize or more membranes or barriers separating the catholyte and the anolyte compartments. The membranes are permselective, that is, they are selectively permeable to either anions or cations. Generally, the permselective membranes utilized are cationically permselective. In membrane cell employing a single membrane, the membrane may be porous or non-porous. In membrane cells employing two or more membranes, porous barriers are generally utilized closest to the anode, and non-porous membranes are generally utilized closest to the cathode. The catholytic product of the membrane cell is a relatively high purity alkali metal hydroxide, usually about 250 to about 350 grams per liter, with about 0.5 percent by weight foreign anions. Examples of membrane cells are described in U.S. Pats. Nos. 3,017,338; 3,135,673; 3,222,267; 3,496,077; 3,654,104; 3,899,403; 3,954,579; and 3,959,085. The catholytic product, or cell liquor, from a membrane cell is purer and of a higher concentration than the product of a diaphragm cell. One of the disadvantages of membrane cells is the relatively short and unpredictable longevity of the membrane material when exposed to the operating conditions encountered in commercial operations.

It has been the objective, but not the result, for diaphragm and membrane cells to commercially produce "rayon grade" alkali metal hydroxide, that is, a product having a contamination of less than about 0.5 percent of the original salt. Diaphragm cells have not been able to produce such a product directly, because anions of the original salt freely migrate into the catholyte compartment of the cell. Membrane cells have the capability to produce a high purity alkali metal hydroxide product but have not been able to consistently and continuously produce such a product because of membrane malfunction, especially of the more efficient hydraulically impermeable types utilized closest to the cathode.

A particularly useful arrangement of membranes in a three compartment cell utilizing a buffer compartment and used to electrolyze and alkali metal halide solution is to position a permeable barrier between the anolyte and the buffer compartments and a hydraulically impermeable cation-permeable membrane between the catholyte and the buffer compartments. The arrangement permits the flow of liquid to and from the anolyte compartment while inhibiting the flow of halogens outward from the anolyte compartment. However, because the porous barrier is not a perfect and absolute barrier to halogens and hypohalites, some of these materials migrate into the buffer compartment to the detriment of the hydrocarbon ion exchange membrane separating the catholyte compartment. The barrier between the catholyte compartment and the adjacent buffer compartment is hydraulically impermeable to solutions, but is selectively permeable to cations, thus allowing alkali metal ions from the buffer compartment to pass therethrough the react with the hydroxyl ions formed in the catholytic compartment. Various arrangements of membranes and various types of membrane materials have been proposed. The present invention is useful in membrane cells and is not limited to any specific compartment arrangement of type of membrane, except that the present invention is particularly adapted to membrane cells having at least one buffer compartment and to membrane cells which include a hydrocarbon membrane.

SUMMARY OF THE INVENTION

The commercial use of membrane cell has been hindered by the relatively small choice of membranes available that will withstand the environment of an electrolytic cell. Many types of ion-exchange membrane materials that would otherwise be extremely useful are susceptible to deterioration and distortion under cell operating conditions. A major cause of such deterioration is the presence in the electrolyte of minor amounts of hypochlorites generated by the cell which react with the membrane material to its detriment. The present invention eliminates this problem and makes a wide variety of ion-exchange materials available for use in membrane cells, which hitherto were deemed unsuited for such use.

The present process relates to the production of high purity alkali metal hydroxide solutions by electrolysis of an alkali metal chloride solution in a membrane cell.

The cell preferably includes at least one buffer compartment separating the anolyte and catholyte compartments. The barrier between the anolyte compartment and the adjacent buffer compartment is porous. Suitable porous barriers are deposited asbestos, porous Teflon, and porous cation-active permselective membranes, the criteria being the ability to stand up under the conditions of an operative electrolytic cell and ability to prevent or inhibit halogen gas from passing through. The barrier between the catholytic compartment and the adjacent buffer compartment is a cation-active, hydrocarbon membrane, preferably substantially hydraulically impermeable to solutions but selectively permeable to cations. A small amount of a membrane protective compound selected from alkali metal sulfites, bisulfites, oxalates, sulfides, or mixtures thereof is added to the electrolyte in the cell. It has been found that this addition substantially prolongs the life of the hydrocarbon membranes and facilitates a reliable and continuous production of a high purity alkali metal hydroxide product from membrane cells. Usually amounts between about 0.01 and about 2.0 percent by weight of the electrolyte have been found useful. Amounts between about 0.01 and about 1.8 percent by weight are aptly employed, and amounts between about 0.01 and about 1.6 percent by weight are preferred. Membrane cells in operation normally may be expected to generate between about 0.1 and about 1.0 grams per liter of alkali metal hypochlorite. The amount of alkali metal hypochlorite in a buffer compartment of an operating cell may be substantially lower, usually in the range of from about 0.01 to about 0.1 percent by weight, because of the flow of electrolyte into the anolyte and, in the case of some cells, a water flux is utilized which is directed across the anolyte membrane and into the anolyte compartment. However, such amounts of alkali metal hypochlorite are found to be detrimental to hydrocarbon ion-exchange membranes. To obviate the deterioration, a stoichiometric amount of an alkali metal sulfite, bisulfite, oxalate, sulfide, or mixture thereof is required. Less than a stoichiometric amount does not effectively remove the detrimental materials. Additions of an excess of more than about 10 percent greater than the necessary stoichiometric amounts are not usually employed because of the increase in foreign anion impurities which subsequently must be removed. However, the impurities which are added by the present method are minor and are simply removed, when utilized in the above ranges, by the normal sulfate purge, characteristic or recirculated brine system utilized with membrane cells.

Although the process of the present invention may be utilized in the electrolysis of any alkali metal chloride, sodium chloride is preferred, and this process is particularly applicable to the electrolysis of sodium chloride. The alkali metal of the halide starting material and the alkali metal of the salt of the added protective compound are, preferably, the same, and most preferably are sodium.

DETAILED DESCRIPTION OF THE INVENTION

The present invention will be described in more detail by a discussion of the accompanying drawing which is incorporated herein by reference.

Membrane cell 11 is shown with three compartments. Compartment 13 is the anolyte compartment; compartment 15 is a buffer compartment; and compartment 17 is the catholyte compartment. It will be understood that, although, as shown in the drawing, and in a preferred embodiment, the membrane cell has a single buffer compartment, a plurality of buffer compartments, e.g. 3 to 6, may be included in the cell. Anolyte compartment 13 is separated from buffer compartment 15 by porous barrier 19. Catholyte compartment 17 is separated from buffer compartment 15 by impermeable, hydrocarbon ion-exchange permselective membrane 21. A feed concentrated solution of sodium chloride is fed into the buffer compartment 15 of cell 11 by line 31. The brine feed flows through porous barrier 19 and into anolyte compartment 13. Anolyte compartment 13 is provided with an anolyte overflow line 20 and may suitably have an anolyte recirculation line 22 where diluted brine is removed, resaturated and subsequently returned as brine feed. The brine flow through the anolyte compartment separator aids in retarding the back flow of sodium hypochlorite into the buffer compartment; however, minor amounts of sodium hypochlorite and dissolved chlorine gas do enter the buffer compartment. Cell 11 is equipped with an anode 23 and a cathode 25, suitably connected to a source of direct current through lines 27 and 29 respectively. Upon passage of a decomposing current through cell 11, chlorine is generated at the anode and removed from the cell in gaseous form through line 33. When a non-porous, or substantially non-porous, membrane is utilized adjacent to the catholyte compartment 17, water is added as needed in the catholyte compartment. Hydrogen is generated at the cathode and is removed through line 35. Sodium hydroxide is formed at the cathode, and a sodium hydroxide solution is removed through line 37. The compounds of the present invention, added to protect the cell membranes and, in particular, hydrocarbon membrane 21, are preferably added along with the sodium chloride feed solution through line 31, but may separately be metered into buffer compartment 15 through line 39. The sodium hydroxide product taken from line 37 is substantially free from sodium chloride, containing less than 1 percent by weight sodium chloride, and, preferably, has a concentration of from about 250 to about 300 grams per liter sodium hydroxide. Suitably, the sodium chloride feed material contains from about 200 to about 320 grams per liter sodium chloride, and, most preferably, from about 250 to about 320 grams per liter. The solution may be neutral or, preferably, acidified to a pH in the range of from 1 to 6 with a suitable acid such as hydrochloric acid.

The electrodes of the cell can be made of any electrically conductive material which will resist the attack of the various cell contents. In general, the cathode is fabricated of iron or steel or a noble metal such as platinum, iridium, ruthenium or rhodium. Of course, when using the noble metals, they may be deposited as surfaces on conductive substrates, e.g., copper, silver, aluminum, steel or iron. The anode materials are preferably of noble metals, or have surfaces of noble metals, noble metal alloy, noble metal oxides, or mixtures thereof, on a conductive substrate, preferably of a valve metal. For example, a platinum-ruthenium surface may be used, on a titanium substrate.

The voltage drop for membrane cells is usually in the range of from about 2.3 to about 5.0 volts from the anode to the cathode. Preferably, the voltage drop ranges between about 3.5 to about 4.5 volts. The current density is usually in the range of from about 1 to about 3 amperes per square inch of electrode surface.

The choice of suitable membranes is vastly extended by the present invention. In the past, various types of membranes have been proposed; however, because of the rapid deterioration rate under cell conditions, very few have proven commercially useful. The present invention also makes possible the commercial use of more efficient types of membranes than those presently in use.

in a preferred embodiment of the present invention, barrier separating the anode compartment is a porous barrier. Membranes or barriers of deposited asbestos or porous polymeric materials such as porous Teflon, or sheets of porous polymeric material may be utilized. The porous barrier must be stable and able to withstand operating cell conditions and able to inhibit the flow of halogen gas therethrough. In one mode of the invention, the membrane is a hydrolyzed copolymer of perfluorinated hydrocarbon and a fluorosulfonated perfluorovinyl ether. More particularly, this membrane is hydrolyzed copolymer of a tetrafluoroethylene and a fluorosulfonated perfluorovinyl ether of the formula: $FSO_2CF_2CF_2OCF(CF_3)CF_2OCF=CF_2$, hereinafter called PSEPVE. The polymer has an equivalent weight of about 900 to about 1,600. This polymer has generally been found suited to membrane cell conditions and is aptly suited to use as the barrier between the anode compartment and the adjacent buffer compartment.

The choices for a barrier between the cathode compartment and the adjacent buffer compartment have been broadened. Many of the hydrocarbon ion-exchange membranes previously proposed for use in electrolytic cells may now be utilized. In general, the hydrocarbon ion-exchange membrane materials useful in the present invention are those known in the prior art. Their structure is usually polymeric, having ionizable radicals fixed to the polymeric matrix. The fixed ions repel ions of a like charge and attract ions of the opposite charge. The attracted ion becomes electrically associated with the fixed ion. Under the influence of an electrical current, ions having a charge similar to the charge of the ions attracted to the fixed ions permeate the material, while ions of the opposite charge are repelled. Such materials may be formed into sheets and are suited to use in electrolytic cells. Examples of useful types of ion exchange materials are polymers having carboxylate groups fixed to the polymeric matrix; hydrolyzed copolymers of divinyl benzene and an olefinic carboxylic compound such as described in U.S. Pat. No. 2,731,408; and hydrolyzed copolymers of the phenyl ester of vinyl sulfonic acid, styrene and divinyl benzene.

Suitable membrane materials separating the catholyte compartment and the adjacent buffer compartment are preferably hydraulically impermeable. It is preferred that the membrane be substantially impervious to water and to ions carrying a negative charge but permeable to ions carrying a positive charge. Permselectivity towards cations or cation-active perselective is defined as the property of the membrane to have a higher transport number for cations than that of the solution in which it is utilized. The membranes useful in the present invention should have as high a cation number as possible and be substantially non-permeable to anions.

The invention has been described with respect to a number of embodiments, but is not to be limited to these because it is evident that those with ordinary skill in the art will be able to utilize substitutes and equivalents without departing from the spirit of the invention or the scope of the claims.

What is claimed is:

1. In a process for producing an alkali metal hydroxide and a halide by the electrolysis of an aqueous metal halide electrolyte in an electrolytic cell having at least three compartments, an anode positioned in an anode compartment, a cathode positioned in a cathode compartment, said anode compartment and said cathode compartment separated by at least one buffer compartment, a porous barrier separating said anode compartment from the adjacent buffer compartment, and a cation-active hydrocarbon membrane separating said cathode compartment from the adjacent buffer compartment, the improvement which comprises:

adding from about 0.01 to about 2.0 percent by weight of the electrolyte of a membrane protective compound selected from the groups of alkali metal sulfites, bisulfites, oxalates, sulfides, or mixture thereof, to the electrolyte in said cell.

2. The process of claim 1 wherein the porous barrier comprises a perfluorosulfonic acid copolymer.

3. The process of claim 2 wherein the porous barrier is a hydrolyzed copolymer of tetrafluoroethylene and a fluorosulfonated perfluorovinyl ether of the formula:

$$FSO_2CF_2CF_2OCF(CF_3)CF_2OCF=CF_2.$$

4. The process of claim 1 wherein the cation-active hydrocarbon membrane is non-porous.

5. The process of claim 4 wherein the said membrane is hydraulically impermeable.

6. The process of claim 1 wherein the membrane protective compound is added with the feed of aqueous alkali metal halide.

7. The process of claim 1 wherein the alkali metal is sodium.

8. The process of claim 1 wherein the halide is chlorine.

9. The process of claim 1 wherein the alkali metal halide is sodium chloride.

10. The process of claim 1 wherein the cell has a single buffer compartment.

11. The process of claim 1 wherein the porous barrier is selected from the group consisting of deposited asbestos, deposited polymeric material, and sheets of polymeric material.

12. The process of claim 1 wherein the membrane protective compound is sodium sulfite.

13. The process of claim 1 wherein the membrane protective compound is sodium bisulfite.

* * * * *